US006871600B2

(12) United States Patent
Norton et al.

(10) Patent No.: US 6,871,600 B2
(45) Date of Patent: Mar. 29, 2005

(54) PULTRUDED PANEL

(75) Inventors: Allen E. Norton, Arlington, TX (US); Stephen W. Smith, Dallas, TX (US); William A. Knapp, Dallas, TX (US); Alex K. Hoover, Ft. Worth, TX (US); Dustin L. Troutman, Hopewell, PA (US)

(73) Assignee: TRN Business Trust, Dallas, TX (US)

( * ) Notice: Subject to any disclaimer, the term of this patent is extended or adjusted under 35 U.S.C. 154(b) by 1 day.

(21) Appl. No.: 10/443,634

(22) Filed: May 22, 2003

(65) Prior Publication Data

US 2003/0196567 A1 Oct. 23, 2003

Related U.S. Application Data

(63) Continuation-in-part of application No. 10/076,165, filed on Feb. 8, 2002, now abandoned.
(60) Provisional application No. 60/267,882, filed on Feb. 9, 2001.

(51) Int. Cl.[7] ..... B61D 17/00
(52) U.S. Cl. ..... 105/404; 105/412; 105/422; 52/784.15
(58) Field of Search ..... 105/404, 355, 105/409, 422, 412, 413; 52/784.15; 228/712.1, 2.1; 156/73.5

(56) References Cited

U.S. PATENT DOCUMENTS

| | | | | | |
|---|---|---|---|---|---|
| 3,003,810 | A | | 10/1961 | Kloote et al. | 296/181 |
| 3,142,265 | A | | 7/1964 | Ford | 105/423 |
| 3,187,853 | A | | 6/1965 | Glaser et al. | 52/377 |
| 3,206,946 | A | | 9/1965 | Lindersmith et al. | 62/407 |
| RE26,131 | E | | 12/1966 | Johansson | 105/409 |
| 3,301,147 | A | | 1/1967 | Clayton et al. | 404/35 |
| 3,323,471 | A | | 6/1967 | Dean et al. | 105/401 |
| 3,481,642 | A | | 12/1969 | Bonallack et al. | 296/31 |
| 3,711,148 | A | | 1/1973 | Hindin | 296/28 |
| 3,777,430 | A | | 12/1973 | Tischuk | 52/309 |
| 4,122,641 | A | | 10/1978 | Bard et al. | 52/396.06 |
| 4,404,057 | A | | 9/1983 | Morrison et al. | 156/324 |
| 5,088,434 | A | * | 2/1992 | Harding | 114/85 |
| 5,109,777 | A | | 5/1992 | Ohmura et al. | 105/401 |
| 5,113,769 | A | | 5/1992 | Okuno et al. | 105/422 |
| 5,274,979 | A | | 1/1994 | Tsai | 52/595 |
| 5,277,011 | A | | 1/1994 | Serrano Martin | 52/588.1 |
| 5,333,554 | A | | 8/1994 | Yamada et al. | 105/397 |
| 5,403,063 | A | * | 4/1995 | Sjostedt et al. | 296/193.07 |
| 5,460,290 | A | | 10/1995 | Hanning et al. | 220/421 |
| 5,677,029 | A | | 10/1997 | Prevorsek et al. | 428/113 |
| 5,685,229 | A | | 11/1997 | Ohara et al. | 105/397 |
| 5,716,487 | A | | 2/1998 | Sumerak | 156/359 |
| 5,730,485 | A | | 3/1998 | Sjostedt et al. | 296/182 |
| 5,765,485 | A | | 6/1998 | Thoman et al. | 105/404 |
| 5,802,984 | A | | 9/1998 | Thoman et al. | 105/404 |
| 5,988,074 | A | | 11/1999 | Thoman | 105/404 |
| 6,000,342 | A | * | 12/1999 | Thoman et al. | 105/413 |
| 6,138,580 | A | | 10/2000 | Thoman | 105/396 |
| 6,227,125 | B1 | * | 5/2001 | Schroeder et al. | 105/401 |
| 6,233,892 | B1 | * | 5/2001 | Tylman | 52/309.12 |
| 6,251,185 | B1 | | 6/2001 | Morrison et al. | 118/681 |
| 6,290,279 | B1 | | 9/2001 | Haight et al. | |

* cited by examiner

*Primary Examiner*—Frantz F. Jules
(74) *Attorney, Agent, or Firm*—Baker Botts L.L.P.

(57) ABSTRACT

Pultruded panels having a first longitudinal edge profile and a second longitudinal edge profile may be used to form a floor assembly mounted on a railway car underframe. The pultruded panels may also be used to form walkways, bridges, piers and other structures. A bead may be placed on at least one of the longitudinal edge profiles to form a gap between an adjacent pultruded panel. An adhesive may be placed within the gap to couple or bond adjacent pultruded panels with each other. Void spaces may be formed within the pultruded panel and filled with foam to provide improved resistance to heat transfer through the respective panel. Respective coverings may be placed on opposite ends of each panel to block access to the associated void spaces.

11 Claims, 10 Drawing Sheets

PULTRUDED PANEL

RELATED APPLICATION

This application is a continuation-in-part application claiming priority to U.S. patent application Ser. No. 10/071,165 entitled "Pultruded Panel", filed on Feb. 8, 2002 now abandoned. That application claims the benefit of provisional application entitled, "Temperature Controlled Railway Car", Ser. No. 60/267,882 filed Feb. 9, 2001.

This application is related to patent application entitled, "Temperature Controlled Railway Car", Ser. No. 10/071,168, filed Feb. 8, 2002, now U.S. Pat. No. 6,575,102; patent application entitled, "Roof Assembly And Airflow Management System For Temperature Controlled Railway Car", Ser. No. 10/071,173, filed Feb. 8, 2002, now U.S. Pat. No. 6,722,287; and patent application entitled, "Manufacturing Facility and Method of Assembling A Railway Car", Ser. No. 10/071,513, filed Feb. 8, 2002, now U.S. Pat. No. 20020148196 which claim priority from the same provisional application.

TECHNICAL FIELD

The present invention is related to pultruded panels, which have multiple uses including forming portions of a floor assembly associated with a composite box structure mounted on a railway car underframe.

BACKGROUND OF THE INVENTION

Over the years, general purpose railway boxcars have progressed from relatively simple wooden structures mounted on flat cars to more elaborate arrangements including insulated walls and custom designed refrigeration equipment. Various types of insulated boxcars are presently manufactured and used. A typical insulated boxcar includes an enclosed structure mounted on a railway car underframe. The enclosed structure generally includes a floor assembly, a pair of side walls, a pair of end walls and a roof. The side walls, end walls and roof often have an outer shell, one or more layers of insulation and interior paneling.

The outer shell of many railway boxcars often has an exterior surface formed from various types of metal such as steel or aluminum. The interior paneling is often formed from wood and/or metal as desired for the specific application. For some applications the interior paneling has been formed from fiber reinforced plastic (FRP). Various types of sliding doors including plug type doors are generally provided on each side of conventional boxcars for loading and unloading freight. Conventional boxcars may be assembled from various pieces of wood, steel and/or sheets of composite materials such as fiberglass reinforced plastic. Significant amounts of raw material, labor and time are often required to complete the manufacture and assembly of conventional boxcars.

The underframe for many boxcars include a center sill with a pair of end sills and a pair of side sills arranged in a generally rectangular configuration corresponding approximately with dimensions for the floor of the boxcar. Cross bearers and cross ties are provided to establish desired rigidity and strength for the associated railway car underframe. A plurality of longitudinal stringers are also often provided on each side of the center sill to support the floor of a boxcar. Examples of such railway car underframes are shown in U.S. Pat. Nos. 2,783,718 and 3,266,441.

Traditionally, refrigerated boxcars often have less inside height than desired for many types of lading and a relatively short interior length. Heat transfer rates for conventional insulated boxcars and refrigerated boxcars are often much greater than desired. Therefore, refrigeration systems associated with such boxcars must be relatively large to maintain desired temperatures while shipping perishable lading.

A wide variety of composite materials have been used to form railway cars and particular boxcars. U.S. Pat. No. 6,092,472 entitled "Composite Box Structure For A Railway Car" and U.S. Pat. No. 6,138,580 entitled "Temperature Controlled Composite Boxcar" show some examples. One example of a composite roof for a railway car is shown in U.S. Pat. No. 5,988,074 entitled "Composite Roof for a Railway Car".

SUMMARY OF THE INVENTION

In accordance with teachings of the present invention, several disadvantages and problems associated with insulated boxcars, refrigerated boxcars and other types of temperature controlled railway cars have been substantially reduced or eliminated. For one embodiment a floor assembly for a composite box structure may be formed from pultruded panels. The present invention may include a composite box structure with a temperature control system and an airflow management system satisfactory for use with a refrigerated boxcar or a temperature controlled railway car. A composite box structure formed in part with pultruded panels in accordance with teachings of the present invention provides enhanced insulation, increased load carrying capacity, better temperature regulation, increased service life, and reduced maintenance costs as compared to a typical refrigerated boxcar.

One aspect of the present includes a floor assembly having a primary floor and a secondary floor. The primary floor may be formed from pultruded panels. Void spaces associated with the pultruded panels may be filled with an insulating foam. The secondary floor may be formed by beams secured to one surface of the primary floor and metal plates or coverings attached to the beams opposite from the primary floor. The beams may have holes to allow air circulation therethrough.

Another aspect of the invention includes bonding selected portions of the floor assembly with adjacent portions of a railway car underframe using a biodegradable structural adhesive. Restraining anchor assemblies formed in accordance with teachings of the present invention allow other portions of the floor assembly to move longitudinally relative to the railway car underframe and restrict vertical movement relative to the railway car underframe.

One aspect of the present invention includes forming panels with a respective pair of longitudinal edge profiles. At least one projection may be formed on one of the longitudinal edge profiles of each panel to create a gap between the longitudinal edge profile of an adjacent panel. The gap may be sized to receive an adhesive to bond adjacent panels with each other. For one application the projection may be a bead formed on the longitudinal edge profile extending along substantially the full length of the panel. For other applications the bead may extend along only a portion of the longitudinal edge profile. Also, projections other than a bead may be satisfactorily used to form the desired gap between adjacent panels.

Technical benefits of the present invention include adhesively bonding or securely attaching selected portions of a floor assembly with a railway car underframe. Other portions of the floor assembly may be slidably coupled with the railway car underframe to allow limited contraction and expansion of the floor assembly relative to the railway car underframe.

Panels may be formed in accordance with teachings of the present invention using various types of commercially available pultrusion techniques. However, the present invention is not limited pultruded panels. Also, panels formed in accordance with teachings of the present invention may be used with a wide variety of railway cars. However, the present invention is not limited to the railway car industry.

BRIEF DESCRIPTION OF THE DRAWINGS

For a more complete understanding of the present invention, and the advantages thereof, reference is now made to the following written description taken in conjunction with the accompanying drawings, in which.

DETAILED DESCRIPTION OF THE INVENTION

Figures 1A, 1B:
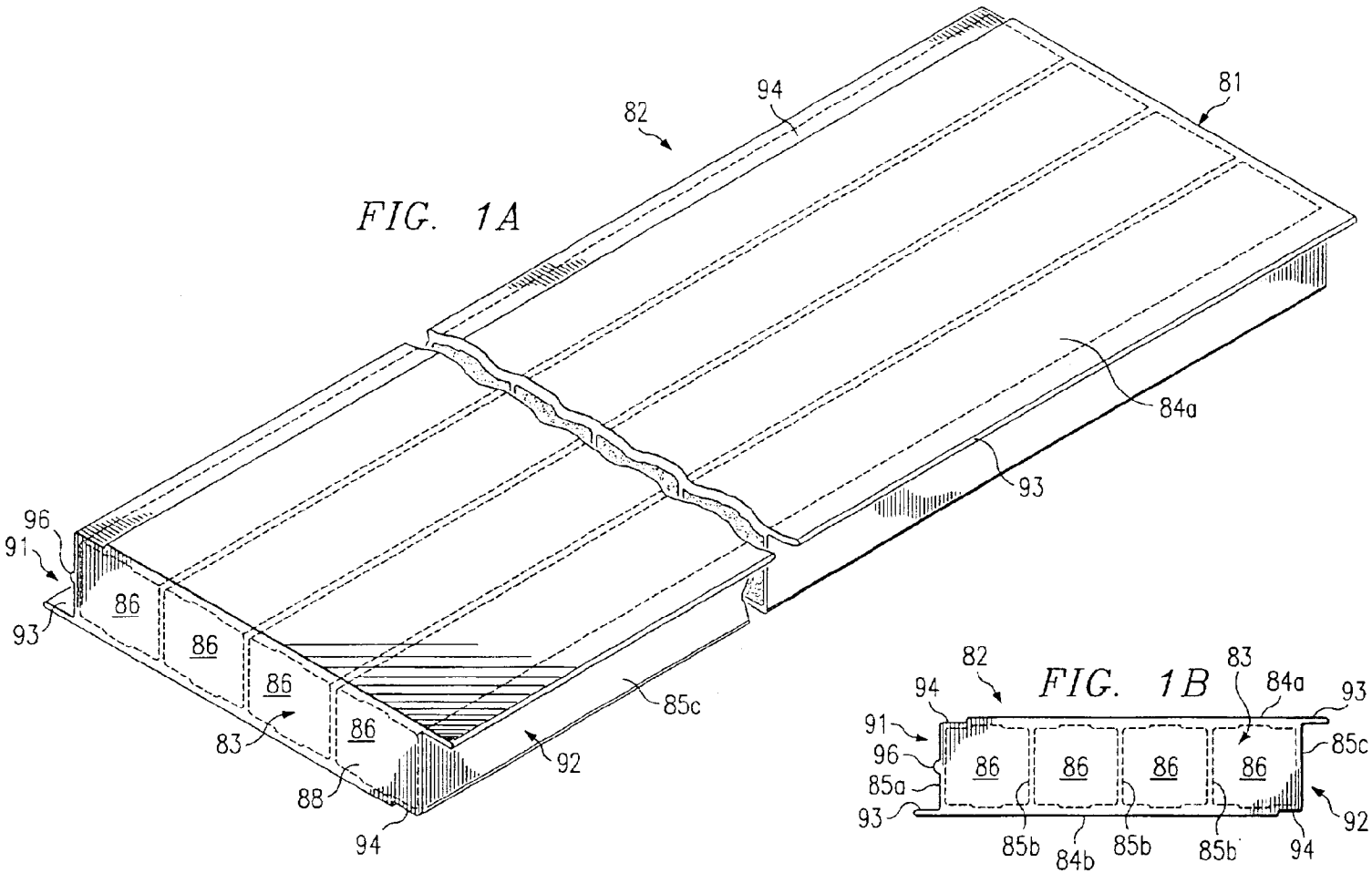
FIG. 1A is a schematic drawing showing an isometric, exploded view with portions broken away of a panel formed in accordance with teachings of the present invention.
FIG. 1B is a schematic drawing showing an end view of the panel of FIG. 1A.

Preferred embodiments of the invention and its advantages are best understood by reference to FIGS. 1A–16 of the drawings, like numerals for like and corresponding parts of the various drawings.

Various aspects of the present invention will be described with respect to forming a floor assembly and interior bulkheads associated with a railway car using pultruded panels. However, the present invention is not limited to panels formed using pultrusion technology (pultruded panels). Panels may be formed in accordance with teachings of the present invention by a wide variety of techniques including injection molding and extrusion technologies. Panels formed in accordance with teachings of the present invention may be satisfactorily used in a wide variety of applications including, but not limited to, commercial buildings, residential building, walkways, bridges, chemical plants, transportation, mass transit and truck trailers (not expressly shown).

U.S. Pat. No. 5,716,487 entitled "Pultrusion Apparatus" assigned to Creative Pultrusions, Inc. (the '487 patent) describes one example of equipment and procedures, which may be used to form pultruded panels. Pultruded panels 82*a*, 82*b*, 82*c* and 282 may be formed from a wide variety of commercially available materials. Examples of some commercially available materials generally include any of the various known heat curable thermosetting polymeric resin compositions such as those based upon unsaturated polyesters, vinyl esters and epoxies, heat curable thermosetting methacrylate resins, modified phenolic resins, bismaleimide resins, addition polymerization thermosetting compositions (e.g., reactive prepolymers, oligomers, or monomers; fillers; pigments; mold release agents; flame retardants; low profile agents; catalysts; inhibitors; air release agents; impact modifiers; and the like), which are described in the '487 patent. Additionally, the commercially available materials of the '487 patent may include reinforcing fibers such as filaments, yarn, roving, mats, felt, ribbon, tape, and fabric (e.g., metal fibers, glass fibers, carbon fibers [graphite], boron fibers ceramic fibers, Kevlar® fibers, synthetic organic fibers such as polyamide and polyethylene fibers, and various other inorganic or organic fibrous materials such as cellulose, asbestos, cotton) that may be in continuous form, usually aligned parallel to the flow of material and including stitched or braided fibers, or any combination thereof. Other examples of commercially available materials include fiber reinforced plastic, thermoset, thermoplastic, urethane and phenolic resins with reinforcement materials such as glass fibers, roving woven mat, continuous strand mat, stitched material mat and carbon fiber.

Various aspects of the present invention will be described with respect to pultruded panels 82 and 282. Alternative embodiments of these panels have been designated 82*a*, 82*b* and 282*a*–*d*. See FIGS. 1A–C, 2, 8 and 15. For embodiments shown in this application, each pultruded panel 82 has a generally rectangular configuration defined in part by first end 81 and second end 83 with first longitudinal edge profile 91 and second longitudinal edge profile 92 extending between first end 81 and second end 83. Longitudinal edge profiles 91 and 92 are spaced from each other.

For one application, each pultruded panel 82 may include first layer 84*a* and second layer 84*b* with a plurality of webs or dividers 85 disposed therebetween. Webs 85*a* and 85*c* form a portion of respective first longitudinal edge profile 91 and second longitudinal edge profile 92. Webs 85*b* may have substantially the same dimensions. For one embodiment, webs 85 disposed between first layer 84*a* and second layer 84*b* form void spaces or cavities 86. Each void space 86 may be filled with insulating foam 88 (see FIG. 1C) having good thermal insulation characteristics. Insulating foam 88 substantially reduces heat transfer through floor assembly 80. Various types of insulating foam such as urethane may be satisfactorily used to fill void spaces 86.

Figure 2:
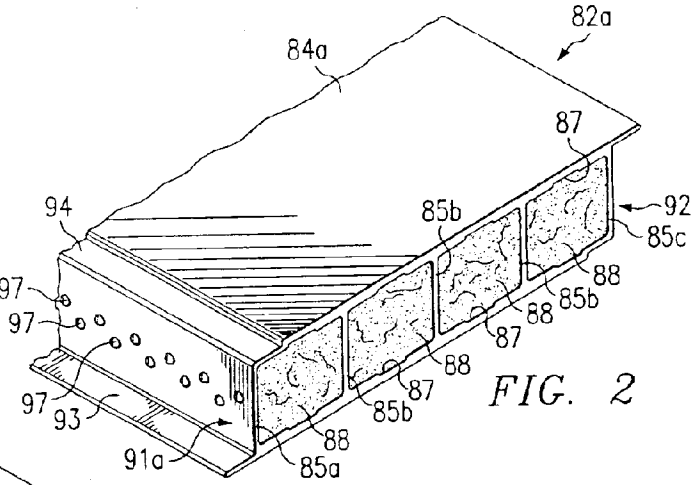
FIG. 2 is a schematic drawing showing an isometric view with portions broken away of another panel formed in accordance with teachings of the present invention.
Figure 1C:
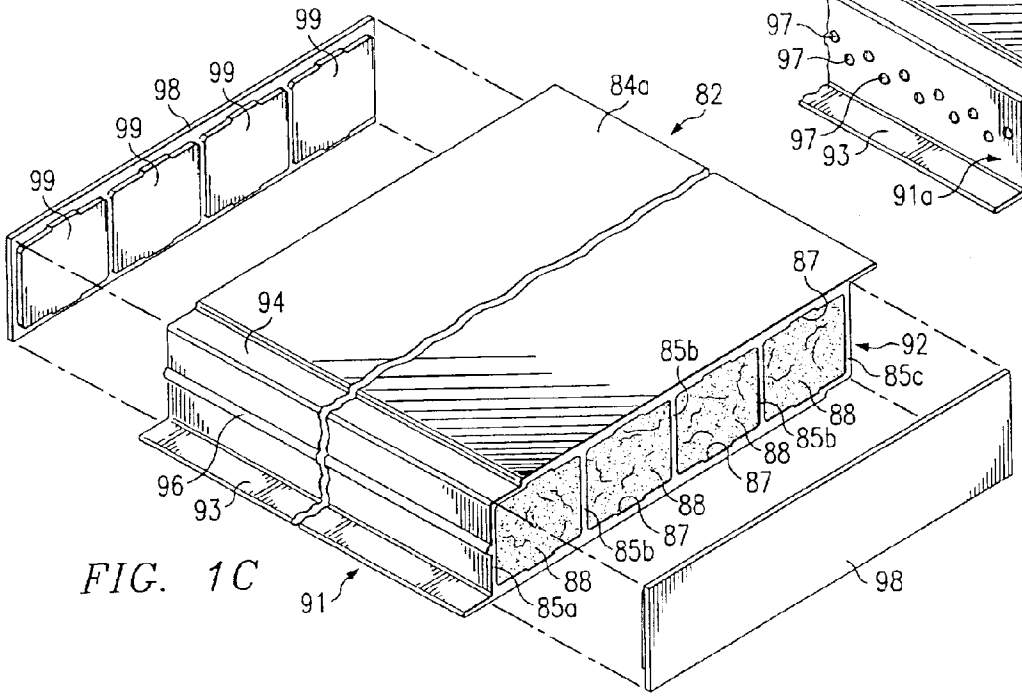
FIG. 1C is a schematic drawing showing another isometric view with portions broken away of the panel of FIG. 1A.

For embodiments of the present invention as shown in FIG. 1A–FIG. 2, a plurality of respective recesses 87 may be formed in first layer 84*a* and second layer 84*b* within each void space 86. Each recess 87 preferably extends longitudinally from first end 81 to second end 83 of the associated pultruded panel 82. Forming recesses 87 reduces overall weight of each pultruded panel 82. As shown in FIGS. 1C and 2, recesses 87 formed in first layer 84*a* and second layer 84*b* cooperate with each other to define a typical I beam configuration for each web 85*b*. As a result, pultruded panel 82 maintains desired rigidity and strength while at the same time having reduced weight which allows a corresponding increase in load carrying capacity of railway car 20.

The configuration of longitudinal edge profiles 91 and 92 are preferably selected to engage respective longitudinal edge profiles 91 and 92 of adjacent pultruded panels 82. See FIG. 9. Longitudinal edge profiles 91 and 92 may include respective flanges or lips 93 which extend laterally therefrom along approximately the full length of the associated pultruded panel 82. Longitudinal edge profile 91 preferably includes respective recess 94 formed in first layer 84*a*. Longitudinal edge profile 92 preferably includes respective recess 94 formed in second layer 84*b*. The dimensions and configurations of flanges 93 are selected to be compatible with recesses 94 of adjacent pultruded panels 82.

Pultruded panels 82 and 82*a* have substantially the same configuration and dimensions except for projections formed on respective longitudinal edge profiles 91. A projection such as bead 96 may be formed along longitudinal edge profile 91 of each pultruded panel 82. When longitudinal edge profile 91 is engaged with an adjacent longitudinal edge profile 92, bead 96 creates a gap therebetween to allow injection of an adhesive compound into the associated gap. The adhesive compound (not expressly shown) may be used to bond or couple adjacent pultruded panels 82 with each other. See FIG. 9. For some applications biodegradable adhesive compounds may be used to bond or couple pultruded panels 82 with each other.

Pultruded panels may be formed in accordance with teachings of the present invention with a wide variety of projections formed on longitudinal edge profiles 91 and/or 92. For some applications more than one bead 96 may be formed on longitudinal edge profile 91. For other applications breaks or discontinuities (not expressly shown) may be formed in bead 96. Pultruded panel 82*a* as shown in FIG. 2 includes a plurality of buttons 97 formed on longitudinal edge profile 91*a*. For some applications serrations and/or ribs (not expressly shown) may be formed as part of one or more longitudinal edge profiles to provide desired projections.

For the embodiment of the present invention as shown in FIGS. 1A–1C respective cover plates or end caps 98 may be placed over first end 81 and second end 83 to block access to associated void spaces 86. Cover plates 98 prevent moisture or other contaminants from contacting insulating foam 88 and reducing its thermal insulating characteristics. Also, any moisture or liquids which enter void spaces 86 may cause an undesired increase in weight of the associated pultruded panel 82. For some applications cover plates 98 may be formed with a generally rectangular configuration corresponding generally with dimensions of respective first end 81 and second end 83. For some applications projections 99 may be formed on each cover plate 98 to engage respective void spaces 86. For example cover plate 98, as shown in FIG. 1C, includes projections 99 with a profile corresponding with the profile of respective void spaces 86.

Cover plates 98 may be formed from fiber reinforced plastic material or any other material compatible with materials used to form the associated pultruded panel 82. Various types of coverings may be placed over the end of panels formed in accordance with teachings of the present invention. The present invention is not limited to the use of cover plates or end caps 98 as shown in FIGS. 1A–1C.

Temperature controlled railway car 20 incorporating teachings of the present invention is shown in FIGS. 3, 4, 6, 10, and 13 with composite box structure 30 mounted on railway car underframe 200. As discussed later in more detail, temperature controlled railway car 20 preferably includes temperature control system 140 and airflow management system 300.

Figure 3:
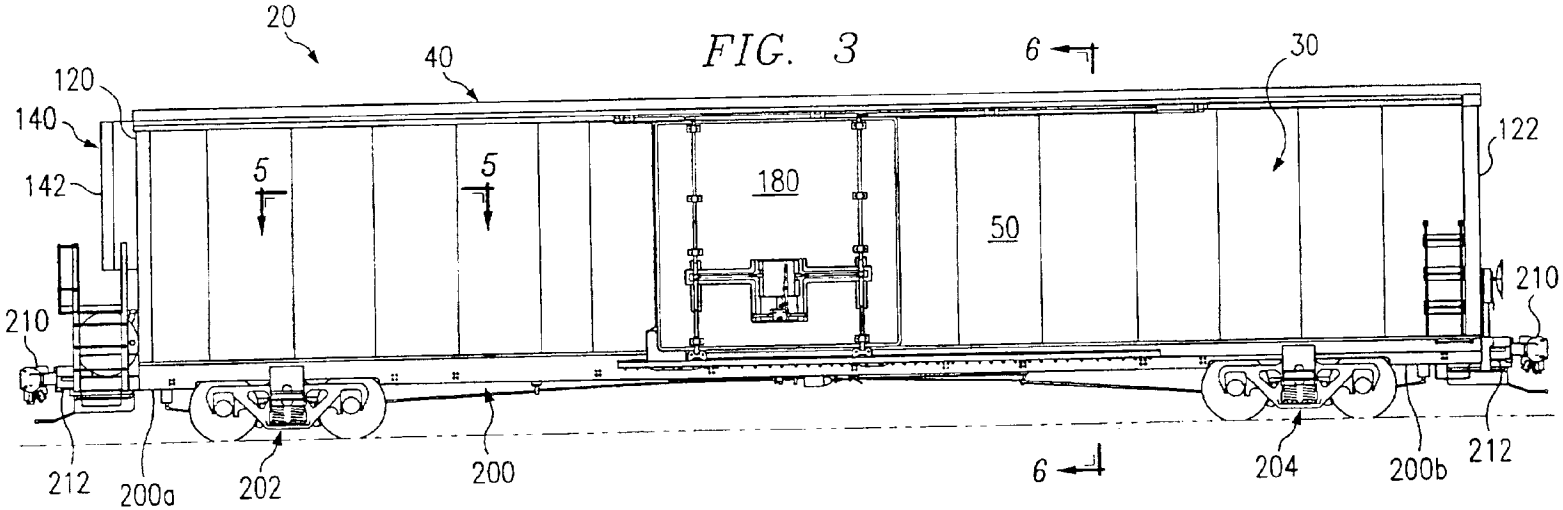
FIG. 3 is a schematic drawing in elevation showing a side view of a temperature controlled railway car having a composite box structure with a temperature control system and an airflow management system.
Figure 4:
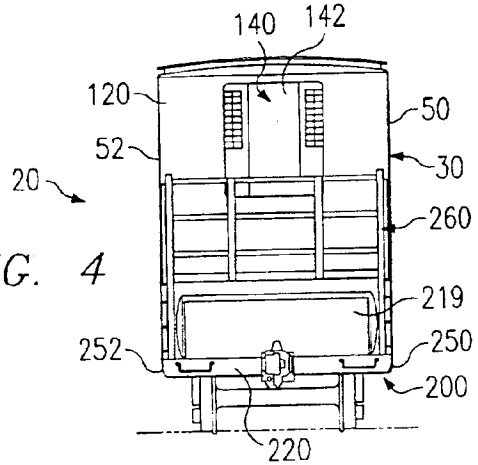
FIG. 4 is an end view of the temperature controlled railway car of FIG. 3.

For embodiments of the present invention as shown in FIGS. 3 and 4, temperature controlled railway car 20 may have exterior dimensions which satisfy requirements of Plate F and associated structural design requirements of the Association of American Railroads (AAR). Forming various components of composite box structure 30 in accordance with teachings of the present invention and assembling such components on railway car underframe 200 results in reducing the weight of temperature controlled railway car 20 and increasing both internal volume and load carrying capacity as compared to many conventional refrigerated boxcars satisfying Plate F requirements. A composite box structure and associated insulated boxcar or temperature controlled railway car may be formed in accordance with teachings of the present invention to accommodate various geometric configurations and load carrying requirements to meet specific customer needs concerning size and temperature specifications for different types of lading.

The term "composite box structure" refers to a generally elongated structure having a roof assembly, a floor assembly, a pair of side wall assemblies, and a pair of end wall assemblies which cooperate with each other to provide a generally hollow interior satisfactory for carrying different types of lading associated with insulated boxcars and refrigerated boxcars. Portions of the roof assembly, floor assembly, side wall assemblies and/or end wall assemblies may be formed from conventional materials such as steel alloys and other metal alloys used to manufacture railway cars. Portions of the roof assembly, floor assembly, side wall assemblies and/or end wall assemblies may also be formed from composite materials such as advanced thermal plastics, insulating foam, fiberglass pultrusions and ballistic resistant fabrics. Examples of some of the materials used to form a composite box structure in accordance with teachings of the present invention will be discussed throughout this application.

Composite box structure 30 may be formed from several major components including roof assembly 40, side wall assemblies 50 and 52, floor assembly 80 and end wall assemblies 120 and 122. Major components associated with composite box structure 30 may be fabricated individually and then attached to or assembled on railway car underframe 200 to form temperature controlled railway car 20. Individually manufacturing or fabricating major components of composite box structure 30 allows optimum use of conventional railcar manufacturing techniques. For example, side stakes and door posts may be welded with top cords and bottom chords using conventional railcar manufacturing techniques to provide structural members for a side wall assembly.

Manufacturing procedures associated with thermoplastic materials and foam insulation may be used to form other portions of composite box structure 30. For example, pultruded panels 82 filled with insulating foam may be used to form portions of floor assembly 80 with substantially improved heat transfer characteristics as compared with conventional refrigerated boxcar floor assemblies. Other portions of floor assembly 80 may be formed using metal I beams and metal deck or floor plates.

Figure 6:
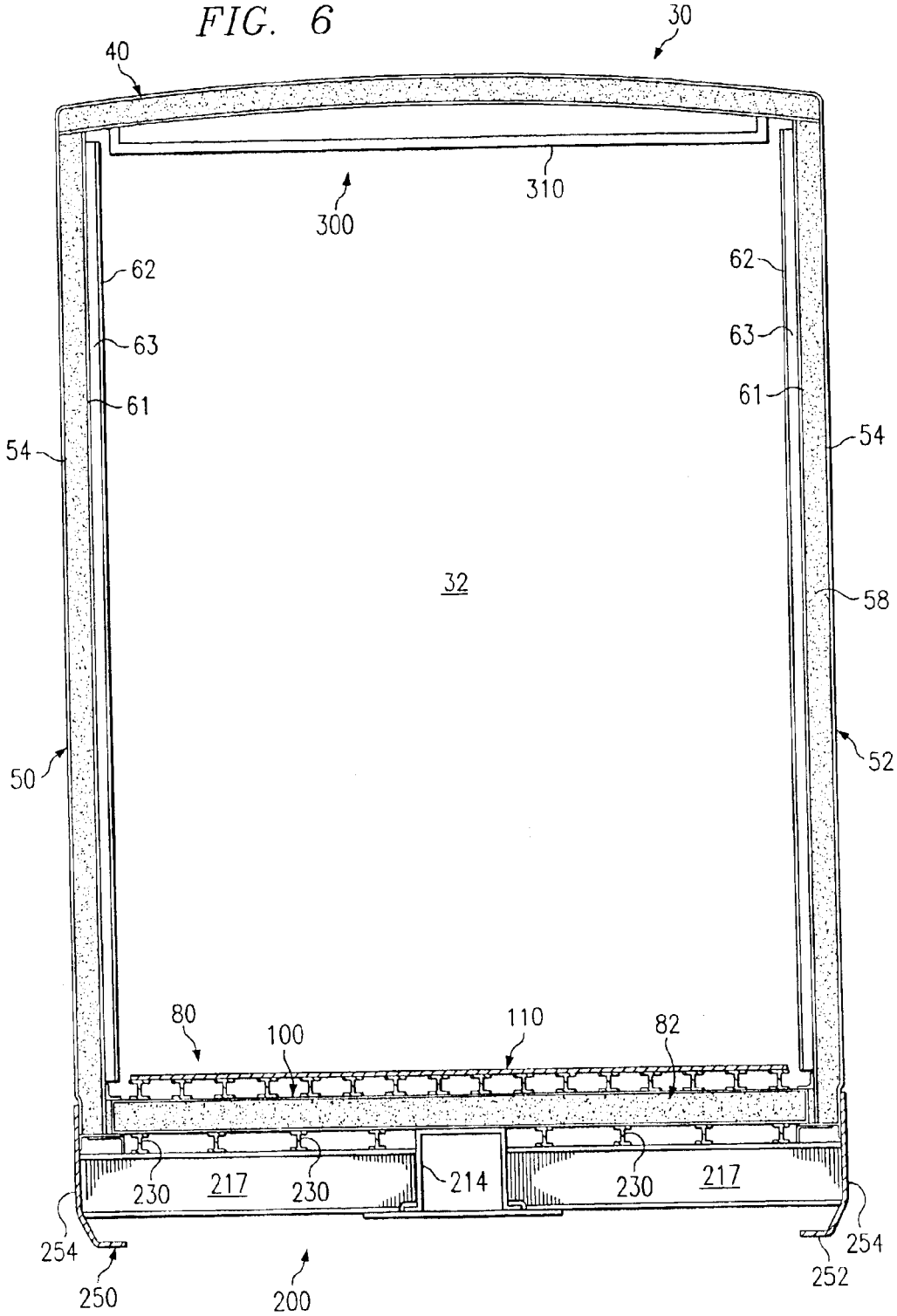
FIG. 6 is a schematic drawing in section with portions broken away taken along lines 6—6 of FIG. 3.
Figure 10:
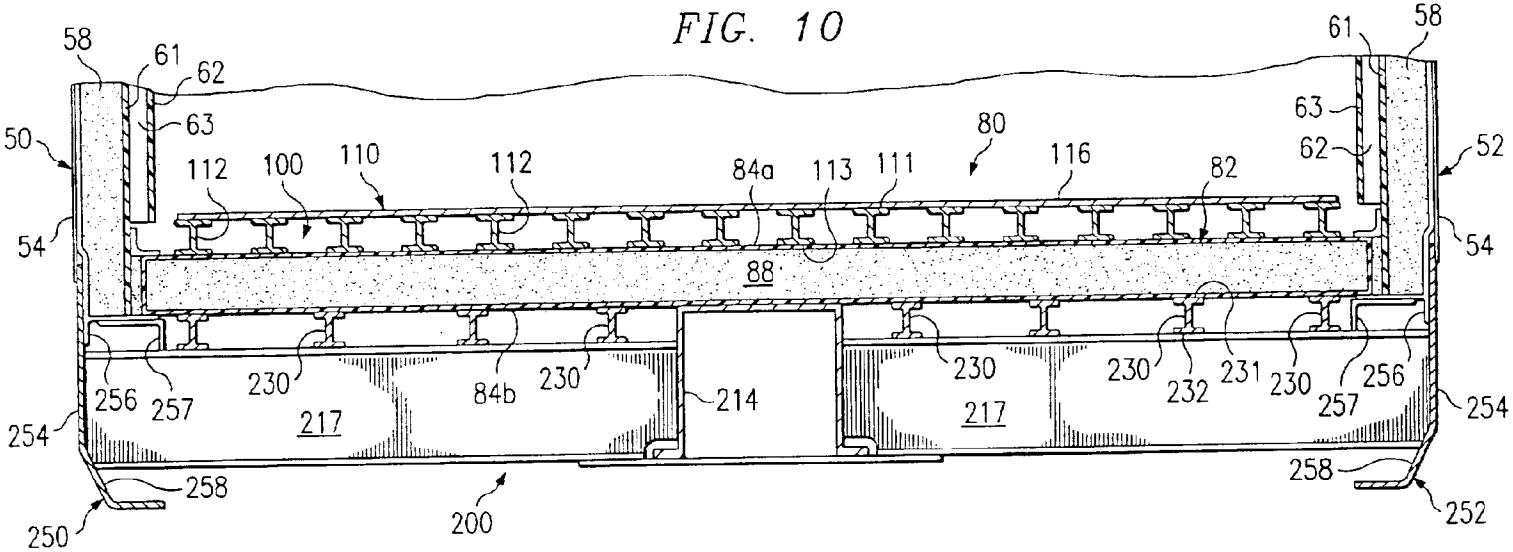
FIG. 10 is a schematic drawing in section with portions broken away showing a floor assembly mounted on a railway car underframe in accordance with teachings of the present invention.
Figure 12:
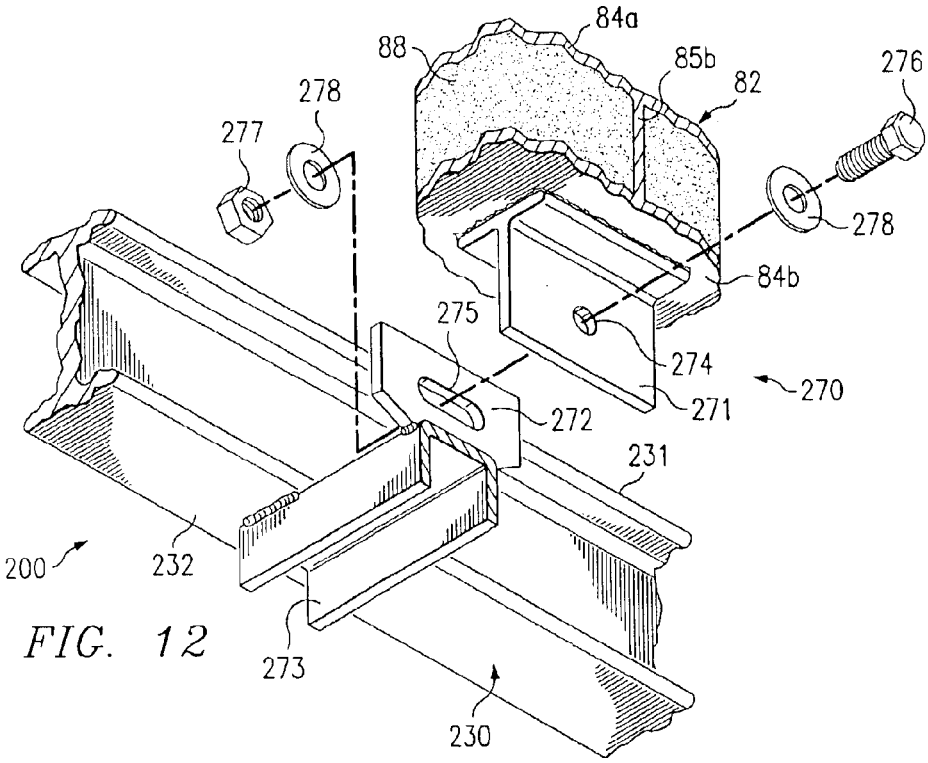
FIG. 12 is a schematic drawing showing an exploded view of a restraining anchor assembly disposed between portions of a floor assembly and portions of a railway car underframe in accordance with teachings of the present invention.
Figure 13:
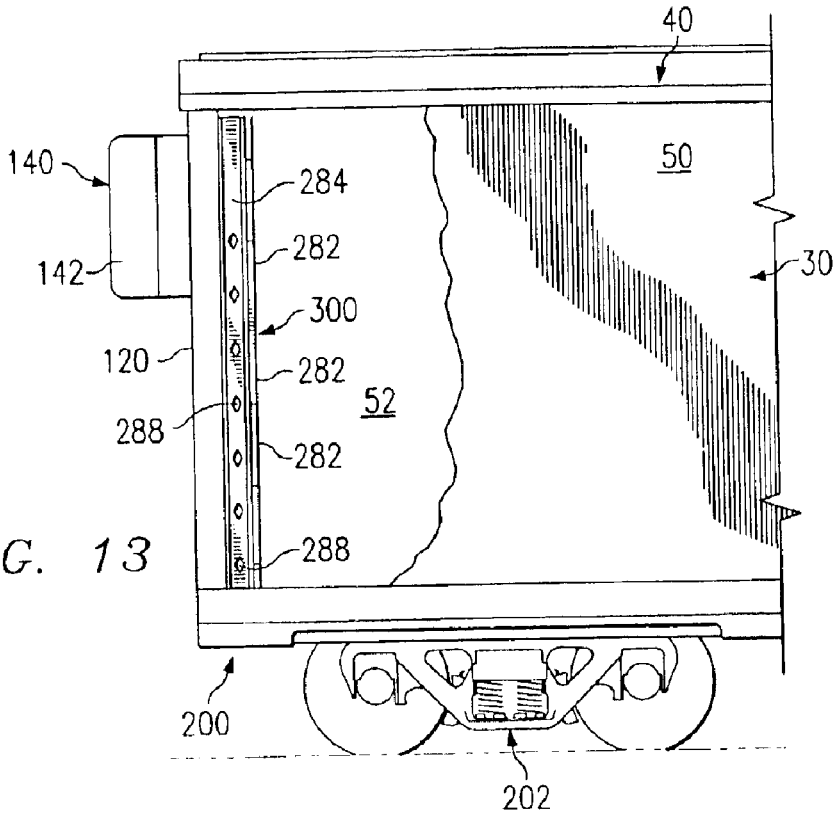
FIG. 13 is a schematic drawing showing a side view with portions broken away of a railway car having an interior bulkhead incorporating teachings of the present invention.

For embodiments of the present invention as shown in FIGS. 3, 4, 6, 10, and 12 portions of railway car underframe 200 may be manufactured and assembled using conventional railcar manufacturing procedures and techniques. Railway car underframe 200 preferably includes a pair of railway car trucks 202 and 204 located proximate each end of railway car underframe 200. Standard railcar couplings 210 may also be provided at each end of railway car underframe 200. Each coupling 210 preferably includes end of car cushioning unit 212 disposed at each end of center sill 214. Railway car underframe 200 preferably includes a plurality of longitudinal stringers 230. FIGS. 6, 10 and 12 show portions of floor assembly 80 disposed on longitudinal stringers 230.

Railway car underframe 200 also includes side sill assemblies 250 and 252 and end sill assemblies 220 and 222. Side wall assemblies 50 and 52 may be fabricated with respective side sill assemblies 250 and 252 formed as an integral component thereof. End wall assemblies 120 and 122 may also be fabricated with at least portions of respective end sill assemblies 220 and 222 formed as an integral component thereof.

Side sills 250 and 252 as shown in FIGS. 6 and 10 have a generally J shaped cross section. The configuration of respective exterior surfaces 254 formed on side sills 250 and 252 preferably corresponds with the dimensions of plate F. Respective longitudinal supporting members 256 are preferably attached to interior surface 258 of each side sill 250 and 252. Respective longitudinal supporting members 257 may also be disposed between each longitudinal supporting member 256 and cross bearers 216. For the embodiment of the present invention as shown in FIGS. 6 and 10 longitudinal supporting members 256 and 257 may be formed by conventional metal angles having desired dimensions compatible with railway car underframe 100 and floor assembly 80. Longitudinal supporting members 256 and 257 provide support for primary floor 100.

Figure 5:
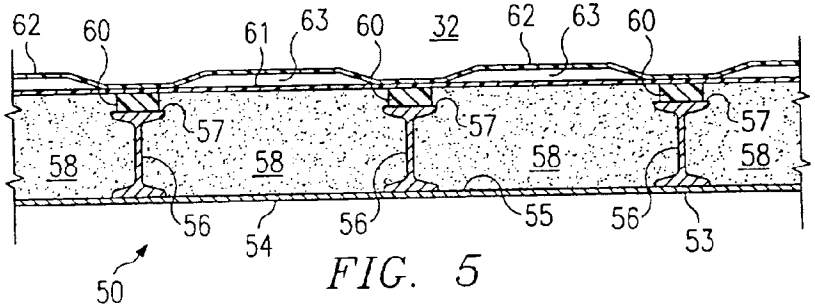
FIG. 5 is a schematic drawing in section with portions broken away showing a portion of a side wall assembly taken along lines 5—5 of FIG. 4.

Side wall assemblies 50 and 52 have substantially the same configuration and overall design. Therefore, various features of composite box structure 30 will be discussed primarily with respect to side wall assembly 50, a portion of which is shown in FIG. 5.

Side wall assembly 50 preferably includes a plurality of metal side sheets 54 disposed on the exterior of composite box structure 30. A plurality of side stakes or support post 56 may be attached to interior surface 55 of each side sheet 54. Support posts 56 project toward interior 32 of composite box structure 30. For some applications, isolator 60 formed from a thermoplastic polymer such as polyvinyl chloride (PVC) insulating material may be attached to interior surface 57 of each support post 56. For other applications alternating blocks of PVC and blocks of insulating foam may be disposed on interior surface 57 of support 56. Various thermoplastic polymers, urethane foams and other types of insulating material may be attached to first surface 57 of each support post 56 to form isolators 60. The present invention is not limited to the use of PVC strips.

First layer 61 of polymeric material may then be attached to isolators 60. Foam insulation 58 may be disposed between adjacent support posts 56 and bonded with the interior surface 55 of side sheets 54, the interior surface of first layer 61 and adjacent portions of support posts 56. For some applications a layer of scrim (not expressly shown) may be attached to the interior surface of first layer 61 to enhance bonding with foam insulation 58. Second layer 62 of polymeric material may be attached to first layer 61.

First layer 61 and second layer 62 are preferably formed from tough, light weight, generally rigid material having high impact resistance. First layer 61 and second layer 62 cooperate with each other to form a liner for composite box structure 30. For some applications first layer 61 and second layer 62 are preferably formed from Bulitex material available from U.S. Liner Company, a division of American Made, Inc. Bulitex material may be generally described as a ballistic grade composite scuff and wall liner.

Various types of ballistic resistant fabric may be satisfactorily used to provide a liner for composite box structure 30. Ballistic resistant fabrics are often formed with multiple layers of woven or knitted fibers. The fibers are preferably impregnated with low modulus elastomeric material as compared to the fibers which preferably have a high modulus. U.S. Pat. No. 5,677,029 entitled "Ballistic Resistant Fabric Articles" and assigned to Allied Signal shows one example of a ballistic resistant fabric.

Second layer 62 preferably has a corrugated cross section which provides desired airflow paths 63 when lading is disposed adjacent to the side wall assembly 50. The corrugated cross section of second layer 62 provides airflow paths 63 which form portions of airflow management system 300.

For one application side sheets 54 may be formed from twelve (12) gauge steel. Support posts 56 may be three (3) inch I beams. Isolators 60 may have dimensions of approximately two (2) inches by two (2) inches by three fourths (¾) of an inch. Foam insulation 58 may have a thickness of approximately four (4) inches. First layer 61 may be formed from Bulitex material having a thickness of approximately 0.04 inches. Second layer 62 may be formed from Bulitex material having a thickness of approximately 0.06 inches. The width of each corrugation formed in second layer 62 may be between approximately four (4) and five (5) inches. The corrugations may form airflow gaps 63 of approximately one half (½) inch relative to first layer 61.

End wall assemblies 120 and 122 may be formed using similar materials and techniques as described with respect to side wall assembly 50. In side wall assembly 50 support posts 56 extend generally vertically from side sill 254 to an associated top chord (not expressly shown). End wall assemblies 120 and 122 may also be formed with I beams (not expressly shown) having a configuration similar to support posts 56. However, respective I beams disposed within each end wall assembly 120 and 122 preferably extend generally horizontally with respect to each other and railway car underframe 200. Such I beams may be referred to as "end beams". Also, end wall assemblies 120 and 122 may be formed with only one layer of polymeric material as compared with first layer 61 and second layer 62 associated with side wall assembly 50.

Railway car underframe 200 may include center sill 214, a plurality of longitudinal stringers 230 and cross ties 216, cross bearers and body bolsters arranged in a generally rectangular configuration. The associated cross bearers and body bolsters are not expressly shown. Cross ties 216 are typically attached to and extend laterally from center sill 214. Longitudinal stringers 230 may be disposed on cross ties 216 and extend parallel with center sill 214. Longitudinal stringers 230 are spaced laterally from each other between center sill 214 and respective ends of cross ties 216. The number of cross ties 216 and longitudinal stringers 230 may be varied depending on the desired load carrying characteristics for the resulting railway car 20. Each longitudinal stringer 230 preferably includes first surface 231 and second surface 232 which rests on associate cross ties 216.

After side wall assemblies 50 and 52 and end wall assemblies 120 and 122 have been attached to railway car underframe 200, portions of floor assembly 80 are preferably installed within composite box structure 30. For some applications a plurality of pultruded panels 82 are preferably bonded with each other to form primary floor 100 having a generally rectangular configuration corresponding generally with the desired interior length and width of composite box structure 30. The length of each pultruded panel 82 preferably corresponds with the desired interior width of composite box structure 30. The number of pultruded panels 82 used to form primary floor 100 is approximately equal to the desired interior length of composite box structure 30 divided by the width of each pultruded panel 82. For the embodiment shown in FIGS. 7 and 8 one or more pultruded panels 82*b* may have a narrower width then pultruded panels 82 to form primary floor 100 with the desired overall length. Pultruded panels 82*b* may include one or more drain openings. See FIG. 8.

After the desired number of pultruded panels 82 have been bonded with each other, the resulting primary floor 100 may be lowered through side wall assemblies 50 and 52 and end wall assemblies 120 and 122 until primary floor 100 engages first surface 231 of longitudinal stringers 230 and portions of side sills 250 and 252 and associated end sills (not expressly shown). For example, FIGS. 6 and 10 show portions of primary floor 100 resting on angle 256 attached with interior surface 258 of side sill 250. Second angle 257 may also be disposed between angle 256 and cross tie 216 to provide additional support for both primary floor 100 and associated side wall assembly 50.

Various techniques and procedures may be used to attach or couple primary floor 100 with longitudinal stringers 230 and/or side sills 250 and 252 and end sills 220 and 222. For some applications only a selected portion of primary floor 100 represented by dotted lines 102 in FIG. 7 may be adhesively bonded or securely attached with adjacent portions of first surfaces 231 of longitudinal stringers 230. Other portions of primary floor 100, which are not attached to longitudinal stringers 230, may expand and contract relative to railway car underframe 200 as temperature changes within composite box structure 30.

Pultruded panels 82, disposed over the middle portion of railway car underframe 200, are preferably bonded with adjacent first surfaces 231 of longitudinal stringers 230. Other portions of primary floor 100 may move longitudinally relative to longitudinal stringers 230 as the temperature within composite box structure 30 changes. FIG. 12 shows one example of a restraining anchor assembly which may be formed between portions of primary floor 100 and portions of selected longitudinal stringers 230 near opposite ends of railway car underframe 200.

Figure 7:
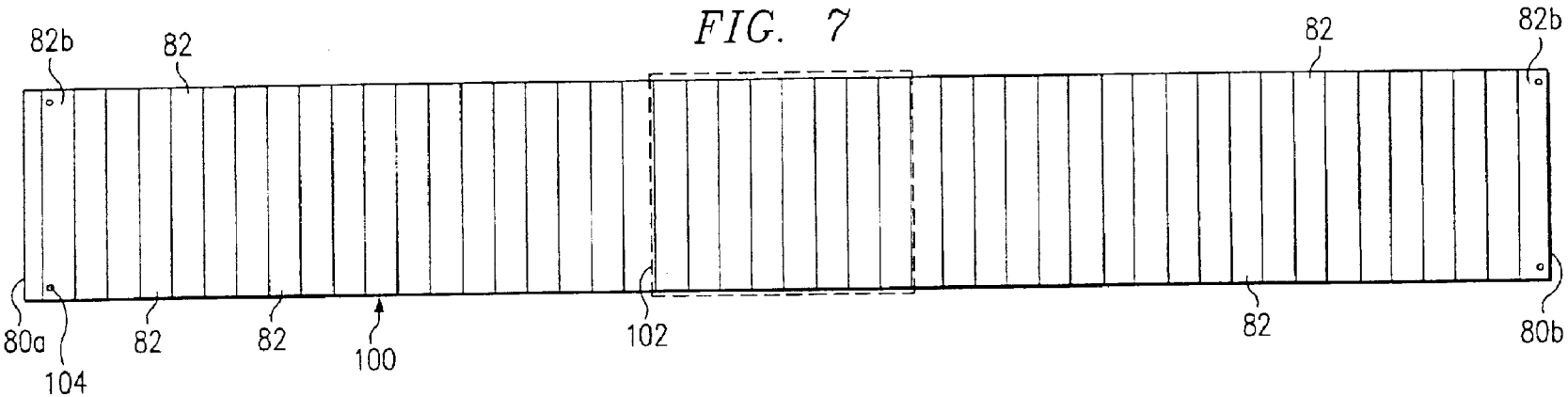
FIG. 7 is a schematic drawing showing a plan view of a primary floor formed in accordance with teachings of the present invention.
Figure 8:
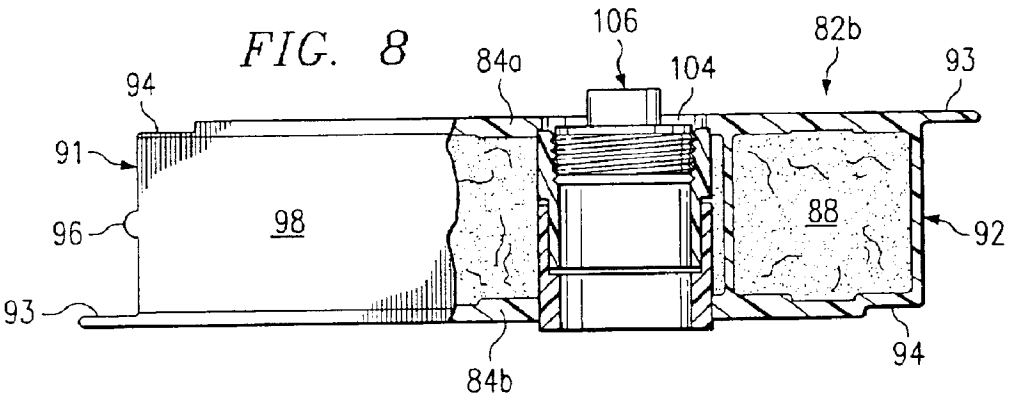
FIG. 8 is a schematic drawing in section with portions broken away showing a pultruded panel with a drain opening formed therein incorporating teachings of the present invention.
Figure 9:
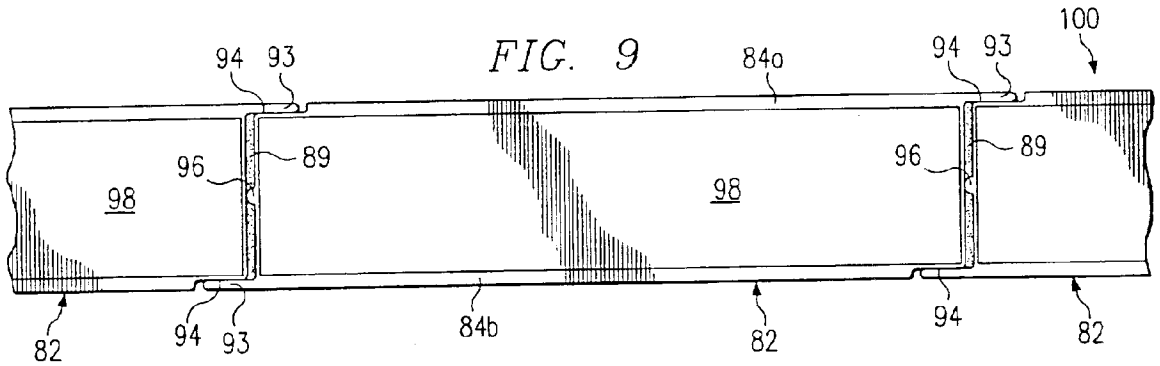
FIG. 9 is a schematic drawing showing an end view with portions broken away of three panels bonded with each other in accordance with teachings of the present invention.
Figure 11:
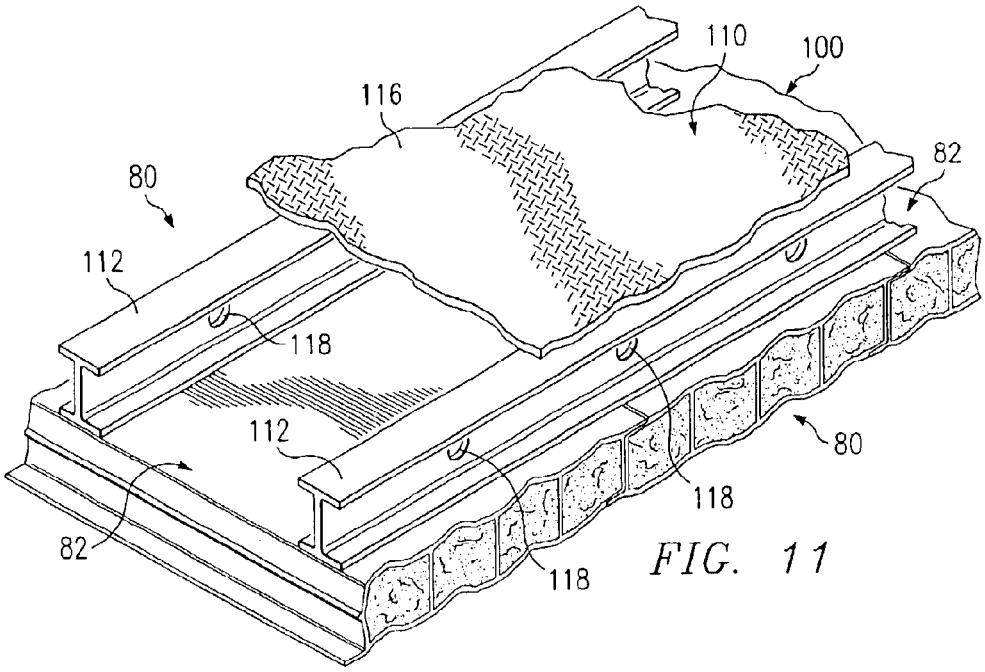
FIG. 11 is a schematic drawing showing an isometric view with portions broken away of a floor assembly having a primary floor and a secondary floor formed in accordance with teachings of the present invention.

Pultruded panel 82*b* may include one or more drain openings 104 with drain plug assembly 106 disposed therein. Various types of commercially available drain plugs may be disposed within each drain opening 104. Drain plug assemblies 106 may be opened to allow cleaning the interior of composite box structure 30. For some applications, floor assembly 80 preferably includes primary floor 100 and secondary floor 110. FIG. 7 shows a top view of primary floor 100 formed in accordance with teachings of the present invention from a plurality of pultruded panels 82. FIG. 9 shows an end view of pultruded panels 82 bonded or coupled with each other to form a portion of primary floor 100. FIGS. 6, 10 and 11 show portions of secondary floor 110 disposed on primary floor 100 opposite from railway car underframe 200.

As shown in FIGS. 6, 10 and 11 secondary floor 110 may be formed by placing a plurality of support beams 112 on pultruded panels 82 opposite from railway car underframe 200. Each support beam 112 may have a configuration or cross section corresponding with a typical I beam. A plurality of deck plates or coverings 116 may be disposed on first surface 111 of each support beam 112. For some applications second surface 113 of each support beam 112 may be adhesively bonded or coupled with portions of first layer 84*a* of adjacent pultruded panel 82. Deck plates or coverings 116 may be adhesively bonded or coupled with first surface 111 of each support beam 112. Alternatively, all or portions of deck plates 116 may be mechanically fastened with support beams 112 using various types of mechanical fasteners such as bolts, rivets, and/or HUCK fasteners (not expressly shown). For some applications support beams 112 and deck plates 116 may be formed from metal alloys or other materials typically associated with forming a floor.

As best shown in FIG. 11, a plurality of openings 118 may be formed in each support beam 112. Openings 111 allow for airflow or air circulation between primary floor 100 and secondary floor 110.

Floor assembly 80 is preferably formed with pultruded panels 82 extending generally perpendicular or normal to center sill 214 and longitudinal stringers 230. Support beams 112 are preferably disposed on pultruded panels 82 spaced from each other and extending generally perpendicular or normal to pultruded panels 82. Attaching deck plates or coverings 116 with support beams 112 provides further support and rigidity for the resulting floor assembly 80.

For the embodiment of the present invention as represented by railway car 20, floor assembly 80 preferably includes first end 80*a* disposed adjacent to first end 200*a* of railway car underframe 200 and second end 80*b* disposed adjacent to second end 200*b* of railway car underframe 200. A central portion of floor assembly 80 corresponding generally with dotted line portion 102 as shown in FIG. 7 may be adhesively bonded with adjacent portions of railway car underframe 200. At least one restraining anchor assembly 270 will be coupled with floor assembly 80 and adjacent portions of railway car underframe 200 proximate first end 200*a*. At least a second restraining anchor assembly 270 will be coupled with floor assembly 80 and adjacent portions of railway car underframe proximate second end 200*b*. For some applications a pair of restraining anchor assemblies 270 will be provided at each end of railway car under-frame 200.

Restraining anchor assembly 270 preferably includes first member 271 securely bonded with or attached to second layer 84*b* of an adjacent pultruded panel 82. Various types of adhesives may be used to bond first member 271 with second layer 84*b*. Second member 272 is preferably securely engaged with adjacent portions of railway car underframe 200. For the embodiment of the present invention as shown in FIG. 12, channel 273 having a generally C-shaped configuration is preferably welded to or otherwise securely attached to adjacent portions of longitudinal stringers 230. Second member 272 may in turn be welded to or otherwise securely attached with channel 273 adjacent to first member 271. For the embodiment of the present invention as shown in FIG. 12, slot 274 is formed in first member 271 and opening or bolt hole 275 is formed in second member 272. For other applications slot 274 may be formed in second member 272 and bolt hole 275 formed in first member 271.

Various types of mechanical fasteners may be used to slidably attach first member 271 with second member 275. For the embodiment of the present invention as shown in FIG. 12, bolt 276 may be inserted through slot 274 and bolt hole 275. Nut 277 may then attached with bolt 276. Slot 274 and bolt 276 cooperate with each other to allow limited longitudinal movement or sliding of first member 271 relative to second member 272 during expansion and/or contraction of floor assembly 80 relative to railway car underframe 200. Bolt 276 and slot 274 cooperate with each other to limit any vertical movement of floor assembly 80 relative to railway car underframe 200 during expansion and contraction of floor assembly 80 relative to railway car underframe 200.

Figure 15:
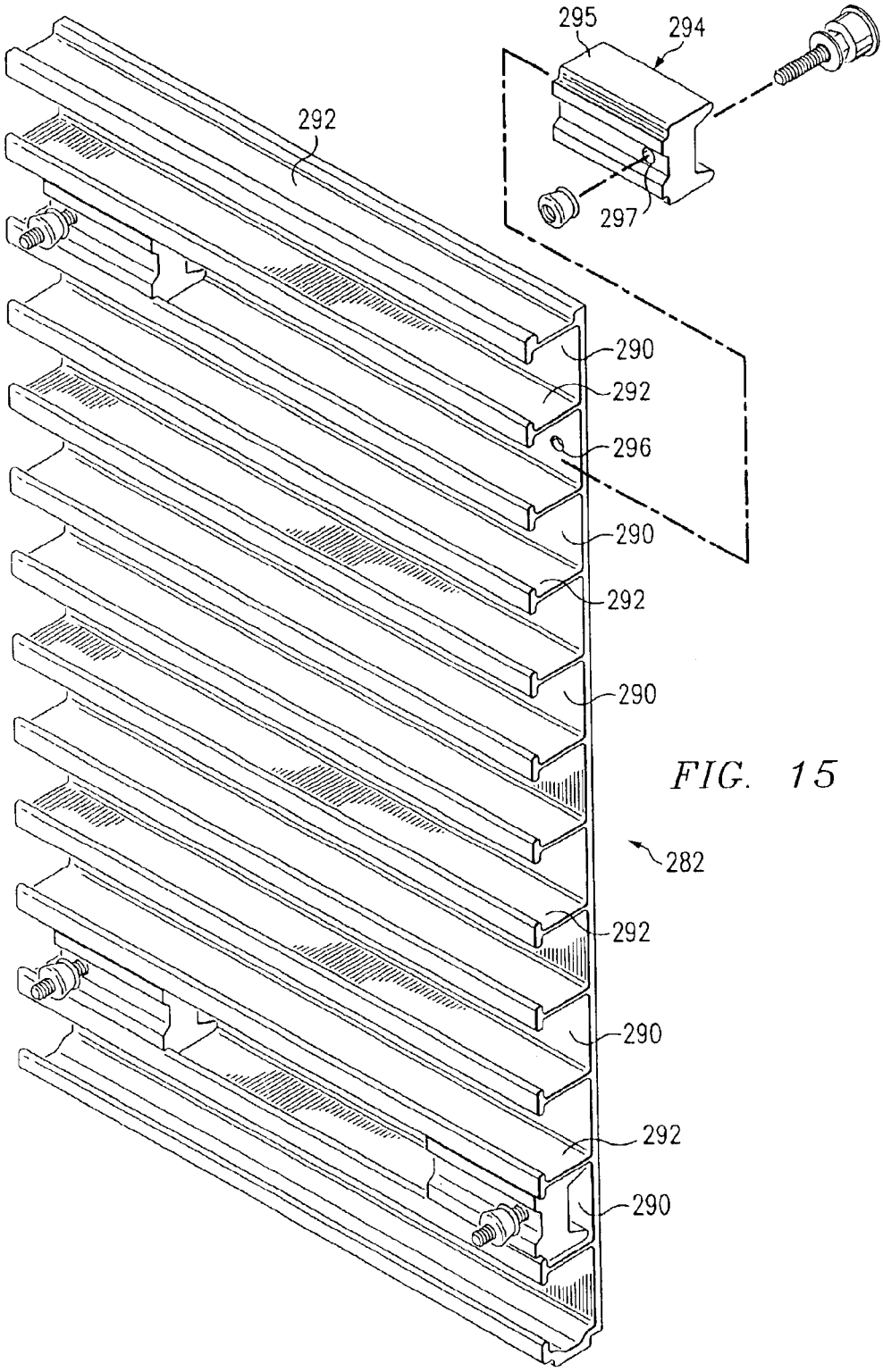
FIG. 15 is a schematic drawing showing an exploded isometric view of a pultruded panel and inserts satisfactory for use in forming an interior bulkhead in according with teachings of the present invention.

For the embodiment of the present invention as shown in FIGS. 6, 10 and 11, secondary floor 110 may be formed using conventional, metal I beams and conventional deck plating or floor coverings. However, for some applications secondary floor 110 may be formed from a plurality of pultruded panels having a cross section similar to pultruded panel 282 as shown in FIG. 15. For still other applications secondary floor 110 may be formed from pultruded panels having a configuration similar to pultruded panels 82. The alternating configuration of longitudinal stringers, primary floor panel and secondary floor components provide a generally strong, rigid structure with opportunities for cost savings and weight reduction from increased use of composite and thermoplastic materials.

Temperature control system 140 preferably includes refrigeration unit or cooling unit 142 and airflow management system 300 which provides uniform, constant airflow around and through lading carried within composite box structure 30. For some applications such as transporting products in sub-zero, winter environments temperature control system 140 may include a heater (not expressly shown). Refrigeration unit 142 may be a self-contained refrigeration unit including a condenser (not expressly shown), airflow blowers (not expressly shown), external fuel tank 219 and a diesel engine (not expressly shown). For some applications, refrigeration unit 142 may provide airflow in the range of 3200 CFM. Self-contained refrigeration unit 142 provides the advantage of easier and faster maintenance as compared to conventional refrigerated boxcars with similar performance characteristics. As a result, temperature control system 140 generally lowers maintenance time and costs and increases the amount of time that temperature controlled railway car 20 remains in service between repairs. Various types of refrigeration systems are commercially available from companies such as Thermo King, Carrier and Dring. Such units are frequently used in motor carrier trailers and other large containers.

As shown in FIGS. 3 and 4, refrigeration unit 142 may be mounted on end wall assembly 120 of the composite box structure 30. End platform system 216 may be coupled to railway car underframe 200 near refrigeration unit 142 to provide easy access to refrigeration unit 142. Refrigeration unit 142 may include external fuel tank 219 located proximate to refrigeration unit 142. This provides the benefit of convenient access to both fuel tank 219 and refrigeration unit 142.

Airflow management system 300 provides a relatively uniform distribution of air at a desired temperature throughout the length, width and height of interior 32 of composite box structure 30. Airflow management system 300 allows cooled air to circulate from refrigeration unit 142, around and through products or lading contained within composite box structure 30, and back to refrigeration unit 142 or out of composite box structure 30. Airflow management system 300 may also be capable of circulating fresh air from outside composite box structure 30 or heated air throughout the interior portion of composite box structure 30.

Airflow management system 300 preferably includes a number of features which keep products shipped within composite box structure 30 spaced from the interior surfaces of the side wall assemblies 50 and 52, end wall assemblies 120 and 122, and floor assembly 80 to create openings or gaps for airflow around the product. These features include ceiling plenum system 310, secondary floor 110, interior bulkhead or end barrier 280, and side wall corrugations formed by second layer 62. Some features of airflow management system 300 may slightly reduce volumetric carrying capacity of composite box structure 30, but allow airflow around and through products shipped inside composite box structure 30 to achieve desired temperature regulation of such products.

Interior bulkhead or end barrier 280 may be formed within composite box structure 30 adjacent to end wall assembly 120. For the embodiment of the present invention as shown in FIGS. 13–16, interior bulkhead 280 may be formed by attaching a plurality of support beams 284 and a plurality of pultruded panels 282 with each other in accordance with teachings of the present invention. Various types of supporting structures other than support beams 284 may be used to attach pultruded panels 282 with adjacent portions of an end wall assembly.

Figure 16:
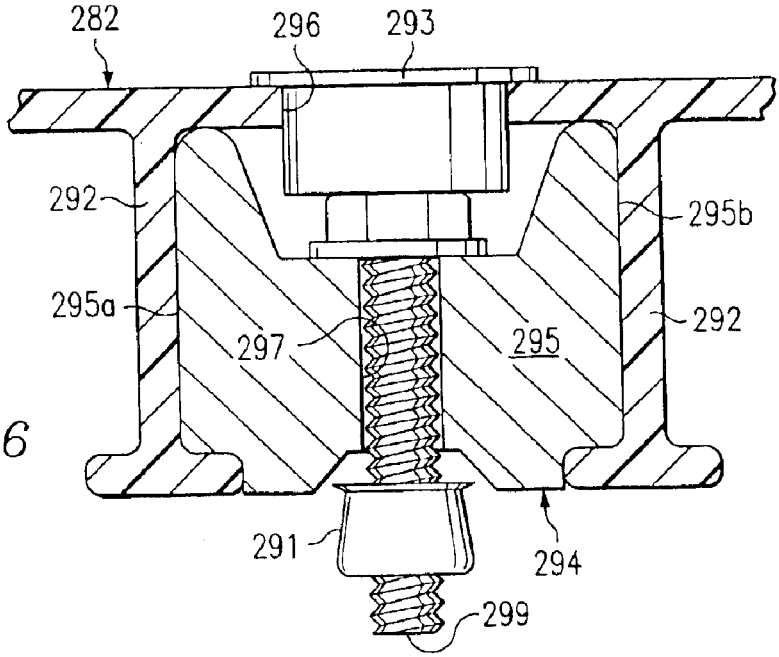
FIG. 16 is an enlarged schematic drawing in section with portions broken away showing portions of a pultruded panel and an attachment insert in accordance with teachings of the present invention.

For one application, support beams 284 may have a cross section corresponding with a conventional I beam. Each support beam 284 preferably includes a respective web 285 with first flange 286 and second flange 287 attached thereto. First flange 286 of each support beam 284 may be securely attached with adjacent portions of wall assembly 120. A plurality of openings 288 may be formed in each web 285 to allow circulation of airflow therethrough. For some applications openings 288 may have a generally football shaped configuration. Pultruded panels 282 may be attached to or mounted on second flange 287 using various techniques such as adhesive bonding or mechanical fasteners. For the embodiment of the present invention as shown in FIGS. 14, 15 and 16 a plurality of openings 298 may be formed in second flange 287 of selected support beams 284 to receive a mechanical fastener.

Pultruded panel 282 may include a plurality of slots 290 formed therein by respective web members 292. A plurality of attaching inserts 292 are preferably disposed within one or more slots 290 for use in mechanically attaching each pultruded panel 282 with associated support beams 284. For embodiments of the present invention as shown in FIGS. 14, 15 and 16, four attaching inserts 292 may be used to mount each pultruded panel 282 with associated support beams 284. However the number of attaching inserts 294 may be varied depending upon the size of the associated pultruding panel. For example, see pultruded panel 282*d* as shown in FIG. 14.

Each attaching insert 294 preferably includes a respective insert body 295 having a pair of opposite exterior surfaces 295*a* and 295*b* sized to be received within a respective slot 290. For some applications insert body 295 may be an aluminum extrusion formed from an aluminum alloy. First opening 296 is preferably formed in and extends through insert body 295. A second opening 297 is preferably formed in pultruded panel 282 at each desired location for a respective attaching insert 284. A third opening 298 may be formed in portions of the supporting structure such as second flange 287 at each desired location for attaching an associated pultruded panel 282. Bolt 299 may be disposed in and extend through first opening 296, second opening 297 and third opening 298. A respective nut 291 may be attached to bolt 299. Also, second opening 297 may be sized to allow inserting cover 293 therein. Various types of bolts, nuts and other mechanical fasteners may be satisfactorily used to attach pultruded panels 282 with a supporting structure formed in accordance with teachings of the present invention.

Figure 14:
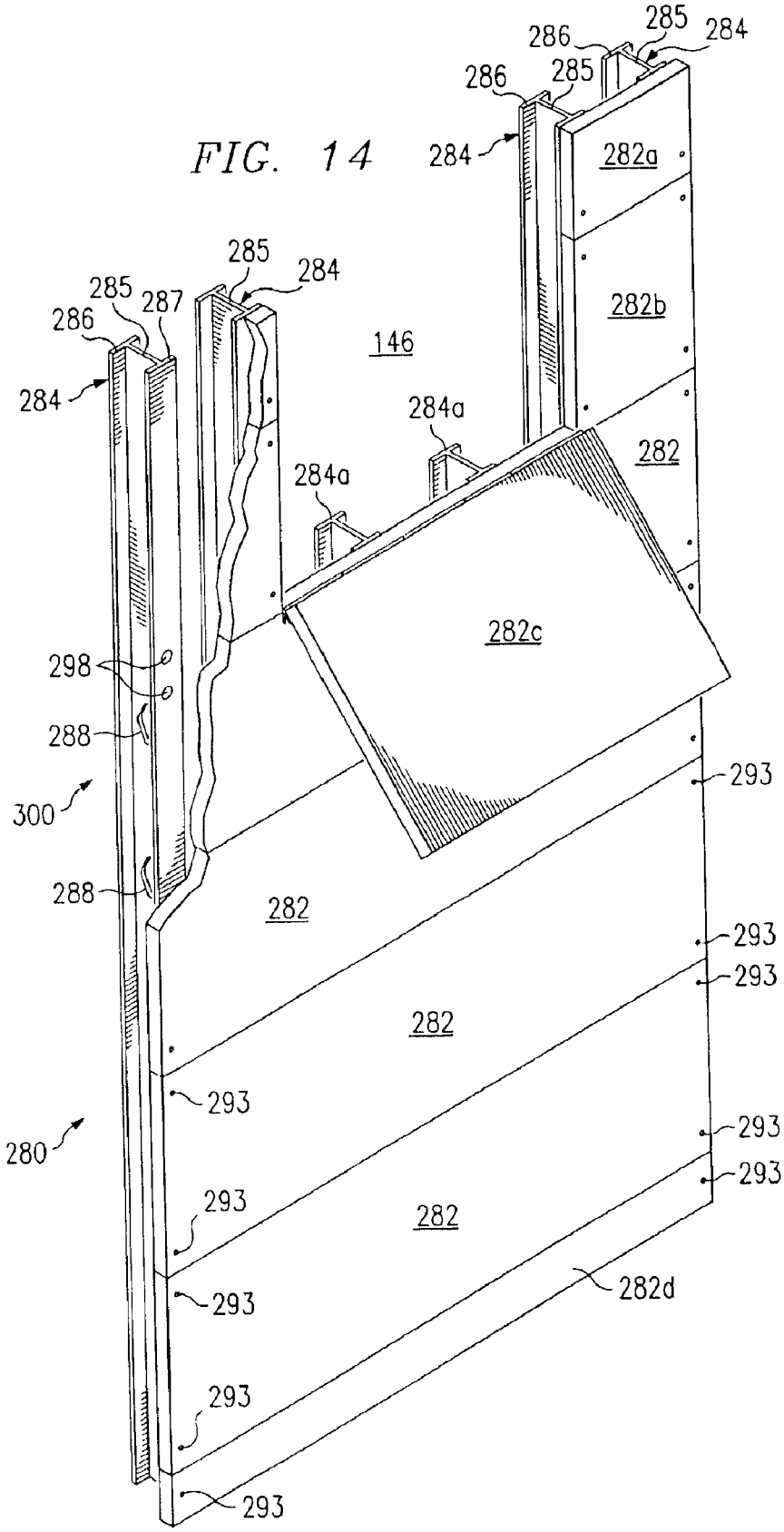
FIG. 14 is a schematic drawing showing an isometric view with portions broken away of the interior bulkhead shown in FIG. 13.

For the embodiment of the present invention as shown in FIG. 14, interior bulkhead 280 may be formed from pultruded panels 282 having various dimensions and configurations. Also, opening 146 may be provided within interior bulkhead 280 to provide access to refrigeration unit 142. For this embodiment the length of support beams 284*a* is substantially less than support beams 284. The difference in length corresponds with desired dimensions for opening 146. Also, pultruded panel 282*c* is preferably hinged with a portion of interior bulkhead 280 adjacent to opening 146. The different sizes and configuration of pultruded panels used to form interior bulkhead 280 include pultruded panels 282, 282*a*, 282*b*, 282*c*, and 282*d*. For some applications, a thin sheet of fiber reinforced plastic (not expressly shown) may be placed over the interior surface of pultruded panels 282 to prevent airflow from going into each slot 290. The thin sheet of fiber reinforcement plastic may be formed from various types of composite and/or plastic materials such as Lexan® to provide desired airflow characteristics between interior bulkhead 280 and adjacent portions of end wall assembly 120.

For the embodiment of the present invention represented by interior bulkhead 280, slots 290 of pultruded panels 282 extend generally horizontal relative to adjacent portions of end wall assembly 120. For some applications pultruded panels 282 may be mounted on an interior surface of end wall assembly 122 with slots 290 disposed generally vertical relative to end wall assembly 122. Air plenum 310 may then be coupled with adjacent portions of pultruded panels 282 (not expressly shown) to direct airflow from air plenum 310 into slots 290 and downwardly through slots 290 to floor assembly 80.

One temperature controlled railway car formed in accordance with teachings of the present invention has the following features:

286,000 lb. Gross Rail Load

Standard car equipped with 10'-0" wide by 11'-3½" high insulated single plug door 15" end-of-car cushioning unit Meets AAR Plate "F" Clearance Diagram State-of-the art temperature control unit, exterior service platform and interior access door Satellite monitoring and control system An airflow management system installed in the interior of the composite box structure High performance insulating materials Durable, wood free interior materials No ferrous metals in the interior

| | |
|---|---|
| Length Inside | 72'-2" |
| Length Over Coupler Pulling Faces | 82'-2" |
| Length over Strikers | 77'-10" |
| Length Between Truck Centers | 52'-0" |
| Truck Wheel Base | 5'-10" |
| Width, Extreme | 10'-6 ⅝" |
| Width, Inside | 9'-2" |
| Height, Extreme | 16"-11 ⅞" |
| Height Inside at Center Line of Car | 12'-1 ½" |
| Estimated Lightweight | 105,000 lbs. |
| Estimated Load Limit - | |
| Based on 286,000 lbs. Gross Rail Load | 181,000 lbs. |
| Gross Rail Load | 286,000 lbs. |
| Cubic Capacity (Between bulkheads) | 8,012 cubic feet |
| Cubic Capacity | 7,883 cubic feet |
| (Level with height of sides) | |

Although the present invention and its advantages have been described in detail, it should be understood that various changes, substitutions and alternations can be made herein without departing from the spirit and scope of the invention as defined by the following claims.

What is claimed is:

1. A floor assembly mounted on a railway car underframe comprising:

a plurality of panels with each panel having a first longitudinal edge profile and a second longitudinal edge profile;

the panels disposed adjacent to each other with the first longitudinal edge profile coupled with the second longitudinal edge profile of adjacent panels;

a respective projection formed on one of the longitudinal edge profiles to create a gap between the respective longitudinal edge profiles of the adjacent panels;

an adhesive disposed within each gap to bond the first longitudinal edge profile with the second longitudinal edge profile of the adjacent panels;

the panels disposed on and secured to the railway car underframe;

a first end located proximate a first end of the railway car underframe;

a second end located proximate a second end of the railway car underframe;

a central portion of the floor assembly disposed between the first end and the second end of the railway car underframe;

the central portion of the floor assembly adhesively bonded with adjacent portions of the railway car underframe;

at least one restraining anchor coupled with the floor assembly and the railway car underframe proximate the first end thereof; at least a second restraining anchor coupled with the floor assembly and the railway car underframe proximate the second end thereof;

wherein each restraining anchor further comprises:

a first member securely coupled with one of the panels;

a second member securely coupled with adjacent portions of the railway car underframe;

at least one of the first and second members having a slot formed therein; and a bolt extending through the first member, the slot and the second member to allow limited longitudinal movement of the first member relative to the second member to limit any vertical movement during thermal expansion and contraction of the floor assembly relative to the railway car underframe.

2. A pultruded panel comprising:

a generally rectangular configuration defined in part by a first end and a second end with a first longitudinal edge profile and a second longitudinal edge profile spaced from each other and extending between the first end and the second end;

a plurality of void spaces formed within the pultruded panel;

each void space filled with an insulating foam;

the first longitudinal edge profile defined in part by a first lip extending laterally therefrom and a first recess formed in the pultruded panel;

the second longitudinal edge profile defined in part by a second lip extending literally therefrom and a second recess formed in the pultruded panel;

at least one projection formed on one of the longitudinal edge profiles to create a gap when a longitudinal edge profile of another pultruded panel is disposed adjacent thereto;

the projection sized to allow the gap to receive an adhesive to bond the pultruded panel with an adjacent pultruded panel;

the void spaces extending from respective openings in the first end to respective openings in the second end of the pultruded panel;

a respective covering placed over the openings at each end of the pultruded panel to block access to the void spaces; and more than two projections formed on the longitudinal edge profiles.

3. A railway car comprising:

a railway car underframe having a generally rectangular configuration defined in part by a first end and a second end with a first side and a second side spaced from each other and extending from the first end to the second end;

a floor assembly attached to the railway car underframe;

a pair of side wall assemblies mounted on respective sides of the railway car underframe;

a pair of end wall assemblies mounted on respective ends of the railway car underframe; the side wall assemblies, end wall assemblies and floor assembly respectively coupled with each other;

a roof assembly attached to the end wall assemblies and the side wall assemblies opposite from the floor assembly;

an interior bulkhead attached to and spaced from an interior surface of one of the end wall assemblies;

a supporting structure disposed between the interior surface of the one end wall assembly and the interior bulkhead;

the interior bulkhead formed from a plurality of pultruded panels with each panel having at least two slots formed in at least one surface thereof; and a plurality of attaching inserts respectively disposed within the slots for use in mechanically attaching the associated pultruded panel with the supporting structure.

4. The railway car of claim 3 wherein each insert further comprises:

an insert body having a pair of opposite exterior surfaces sized to be received within one of the slots of the associated pultruded panel;

a first opening formed in and extending through the insert body;

a second opening formed in an adjacent portion of the associated pultruded panel;

a third opening formed in the supporting structure;

a bolt extending through the first opening in the insert body;

a first end of the bolt attached to a first mechanical stop disposed within the second opening to engage the insert body with the pultruded panel;

a second end of the bolt extending through the third opening in the supporting structure; and a second mechanical stop attached to the second end of the bolt to securely engage the associated pultruded panel with the supporting structure.

5. The railway car of claim 3 further comprising:

an open formed in the interior bulkhead to provide access to portions of an associated temperature control system;

a door attached to the opening;

the door having a first position blocking access through the open and a second position allowing access through the opening; and the door resting against adjacent portions of the interior bulkhead when the door is in its second position.

6. The railway car of claim 3 wherein the supporting structure further comprises:

a plurality of support beams with each support beam having a generally I shaped cross section defined in part by a respective web attached to and extending between a first flange and a second flange;

the first flange securely attached with adjacent portions of the associated end wall assembly;

a plurality of openings formed in each of the webs to allow circulation of airflow therethrough; and a plurality of openings formed in the second flange of selected support beams for mechanical engagement with one of the inserts.

7. The railway car of claim 6 wherein the openings formed in the web further comprise a generally football shaped configuration.

8. The railway car of claim 3 wherein at least one insert further comprises an insert body formed from an aluminum alloy.

9. The railway car of claim 3 wherein at least one insert further comprises an insert body formed from an aluminum extrusion.

10. A railway car comprising:

a railway car underframe having a generally rectangular configuration defined in part by a first end and a second end with a first side and a second side spaced from each other and extending from the first end to the second end;

a floor assembly disposed on and attached to the railway car underframe;

a first end of the floor assembly located proximate the first end of the railway car underframe;

a second end of the floor assembly located proximate the second end of the railway car underframe;

a central portion of the floor assembly disposed between the first end and the second end of the railway car underframe;

the central portion of the floor assembly securely bonded with adjacent portions of the railway car underframe;

at least one restraining anchor coupled with the floor assembly and the railway car underframe proximate the first end thereof;

at least a second restraining anchor coupled the floor assembly and the railway car underframe proximate the second end thereof; and the restraining anchors cooperating with each other to allow only limited movement of the floor assembly relative to the railway car underframe during thermal expansion and contraction of the floor assembly.

11. The railway car of claim 10 wherein each restraining anchor further comprises:

a first member securely coupled with a portion of the floor assembly;

a second member securely coupled with adjacent portions of the railway car underframe;

at least one of the first and second members having a slot formed therein; and a bolt extending through the first member, the slot and the second member to allow limited movement of the first member relative to the second member during thermal expansion and contraction of the floor assembly relative to the railway car underframe.

* * * * *

UNITED STATES PATENT AND TRADEMARK OFFICE

CERTIFICATE OF CORRECTION

PATENT NO. : 6,871,600 B2
DATED : March 29, 2005
INVENTOR(S) : Allen E. Norton et al.

It is certified that error appears in the above-identified patent and that said Letters Patent is hereby corrected as shown below:

Title page,
Item [63], Related U.S. Application Data, delete "10/076,165" and insert -- 10/071,165 --.

Signed and Sealed this

Thirty-first Day of January, 2006

JON W. DUDAS
*Director of the United States Patent and Trademark Office*